US006666565B2

(12) United States Patent
Gabe

(10) Patent No.: US 6,666,565 B2
(45) Date of Patent: Dec. 23, 2003

(54) LIGHT EMITTING DIODE (LED) FLASHLIGHT

(75) Inventor: Neiser Gabe, Port Jefferson Station, NY (US)

(73) Assignee: Arista Enterprises Inc., Hauppauge, NY (US)

( * ) Notice: Subject to any disclaimer, the term of this patent is extended or adjusted under 35 U.S.C. 154(b) by 0 days.

(21) Appl. No.: 10/291,308

(22) Filed: Nov. 8, 2002

(65) Prior Publication Data

US 2003/0184999 A1 Oct. 2, 2003

Related U.S. Application Data

(63) Continuation-in-part of application No. 10/112,023, filed on Mar. 29, 2002.

(51) Int. Cl.[7] ..... F21L 4/02
(52) U.S. Cl. ..... 362/184; 362/208; 362/800
(58) Field of Search ..... 362/184, 208, 362/202, 249, 800

(56) References Cited

U.S. PATENT DOCUMENTS

| | | | | | |
|---|---|---|---|---|---|
| 4,587,601 | A | * | 5/1986 | Collins | 362/235 |
| 5,667,293 | A | * | 9/1997 | Own | 362/184 |
| 5,929,788 | A | * | 7/1999 | Vukosic | 340/908.1 |
| 6,231,207 | B1 | * | 5/2001 | Kennedy et al. | 362/158 |

* cited by examiner

*Primary Examiner*—Laura. K. Tso
(74) *Attorney, Agent, or Firm*—Keusey, Tutunjian & Bitetto, P.C.

(57) ABSTRACT

A light emitting diode (LED) flashlight that utilizes reflection techniques to maximize light provided by the one or more LED light sources. A reflection housing is connected to the flashlight housing and includes a light housing that is suspended within the reflection housing and positions the LED light source toward the flashlight handle. Reflective surfaces within the reflection housing receive the light emanating from the LED light source and reflect and re-direct the light out the transparent end opposite the flashlight handle.

26 Claims, 4 Drawing Sheets

LIGHT EMITTING DIODE (LED) FLASHLIGHT

RELATED APPLICATION INFORMATION

This application is a Continuation in Part of U.S. patent application Ser. No. 10/112,023 filed Mar. 29, 2002, pending.

BACKGROUND OF THE INVENTION

1. Field of the Invention

The present invention relates to flashlights, and more particularly to flashlights using Light Emitting Diodes (LEDs) as the light source.

2. Description of the Prior Art

U.S. Pat. No. 6,231,207 to Kennedy et al., discloses a light emitting diode flashlight lamp. This reference discloses the use of an LED as a direct source of light for a flashlight assembly. As shown, the LED is contained in an end cap housing that is threaded onto an end of a translucent cylinder. In this manner, the end cap, and corresponding LED can be positioned to shine light away from the cylindrical tube (i.e., in flashlight mode) or can be positioned to shine light into the cylindrical tube (i.e., in lamp mode). In the standard flashlight mode, the '207 patent has simply replace the incandescent light source with a LED. Even with the bright white light LEDs currently available, the LED light source fails to provide a sufficiently disperse light for use as a conventionally flashlight.

U.S. Pat. Nos. 6,070,987, 6,213,623, 6,293,684, 5,622,423, 5,697,695 and 5,036,442 all disclose various different types of light wands or traffic control devices that are flashlight-like in shape and utilize one or more LEDs as a light source for the wand. In each instance the one or more LEDs are used in order to light the wand and a translucent material is used as the cylindrical rod in which the LEDs are disposed.

SUMMARY OF THE INVENTION

It is an object of the present invention to provide a flashlight that utilizes one or more LEDs as the light source.

It is another object of the invention to provide an LED flashlight that utilizes reflection techniques to maximize the LED light.

These and other objects are achieved in accordance with an embodiment of the invention wherein the flashlight has a power source, a switch electrically connected to the power source, an LED light source electrically connected to the switch and being positioned to direct light toward the handle, and a reflection housing connected to the handle and positioned to receive the light directed toward the handle and reflect it away from the handle.

In accordance with another embodiment, the flashlight has a power source, a switch electrically connected to the power source, an LED light source electrically connected to the switch, and a reflection housing connected to the handle and having a transparent end opposite said handle and a central support axially disposed therein. The central support has reflective surfaces positioned in front of the LED light source such that the light emanating from the LED light source is intercepted by said reflective surfaces and internally reflected within said reflection housing before released through said transparent end.

According to yet another embodiment, the flashlight includes a plurality of LED light sources circumferentially disposed around the outer edge of the reflection housing facing toward the handle. The reflective surfaces within the reflection housing receive the light emanating from the plurality of LEDs and reflects the same out of the reflection housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numeral denote similar components throughout the views.

DETAILED DESCRIPTION OF PREFERRED EMBODIMENTS

Figure 1:
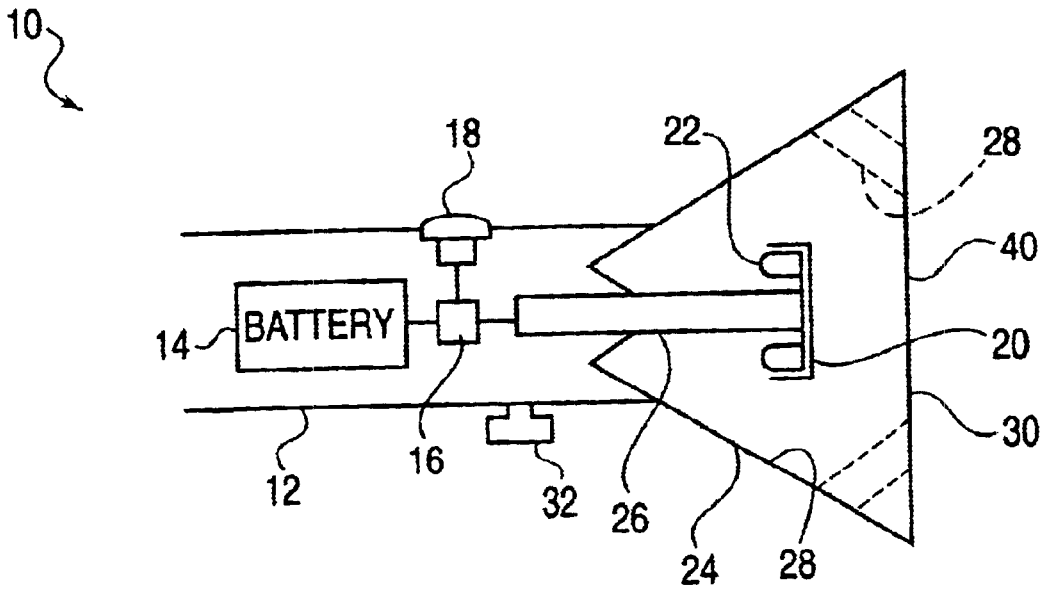
FIG. 1 is a schematic representation of the LED flashlight according to an embodiment of the invention

FIG. 1 shows the LED flashlight 10 according to a first embodiment of the invention. Flashlight 10 includes a handle 12 which generally contains a battery 14, a switch 16 and a button or lever 18 connected to the switch for selectively providing power from the battery to the light source. A reflective housing 24 is connected to the handle and includes a front transparent window or end 30. Reflective housing 24 also contains the light housing 20 having one or more LED lights sources 22 mounted therein.

In this embodiment, light housing 20 is supported on a central support 26 extending from the handle portion 12 into the reflective housing 24 and light source 22 is disposed such that light emanating there from is directed toward the handle. The inside reflective surfaces 28 of reflective housing 24 are positioned to internally receive and reflect the light from light source 22 in a direction opposite the handle 12 and out the transparent end 30 of the reflective housing. The exposed portions of light housing 20 and central support 26 can also include reflective surfaces to enhance the internal reflection. Those of skill in the art will recognize that the angles and positions of the reflective surfaces 28 may be changed, altered or otherwise manipulated to obtain the desired lighting effect from flashlight 10. Examples of such alterations in reflective surfaces 28 are shown in dotted lines.

The central support 26 can be fixedly mounted within handle 12 and reflective housing 24, but may also be adjustably mounted within the handle. This adjustment will be described later with reference to FIG. 4.

Figure 2:
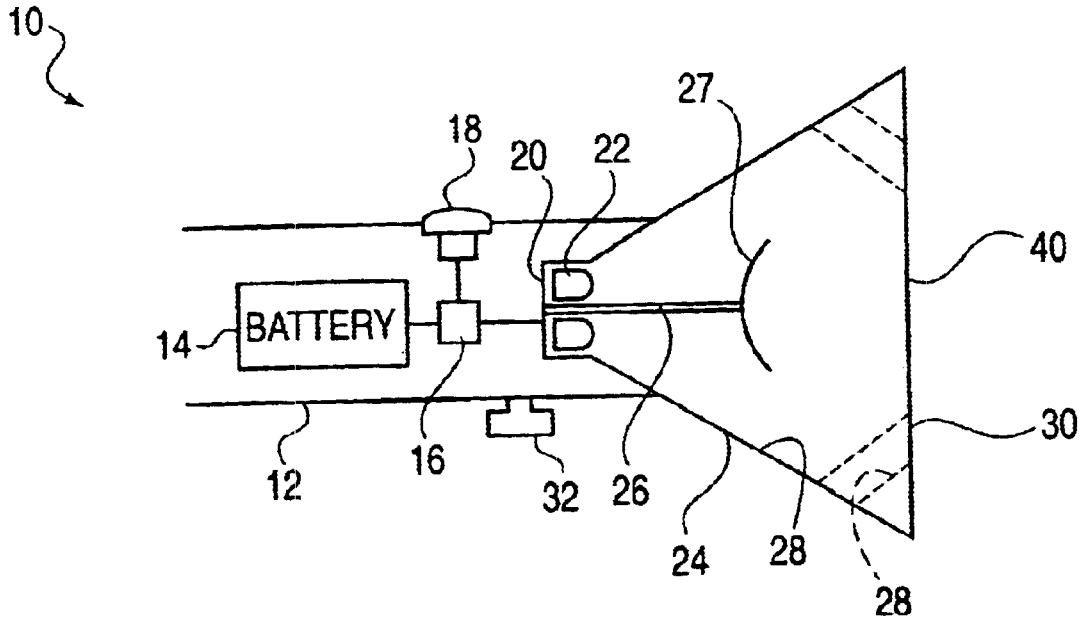
FIG. 2 is a schematic representation of the LED flashlight according to another embodiment of the invention.

FIG. 2 shows flashlight 10 according to a second embodiment of the invention. In this embodiment, the light housing 20 is positioned such that the light source 22 is directed away from the handle 12 and central support 26 includes a reflective surface 27 disposed in front of the light source 22. Reflective surface 27 is positioned to intercept the light emanating from light source 22 and reflect it back toward the reflective surfaces 28 within reflective housing 24. Once intercepted, the light is internally reflected within reflective housing 24 before it is released through the transparent end 30.

Figure 3:
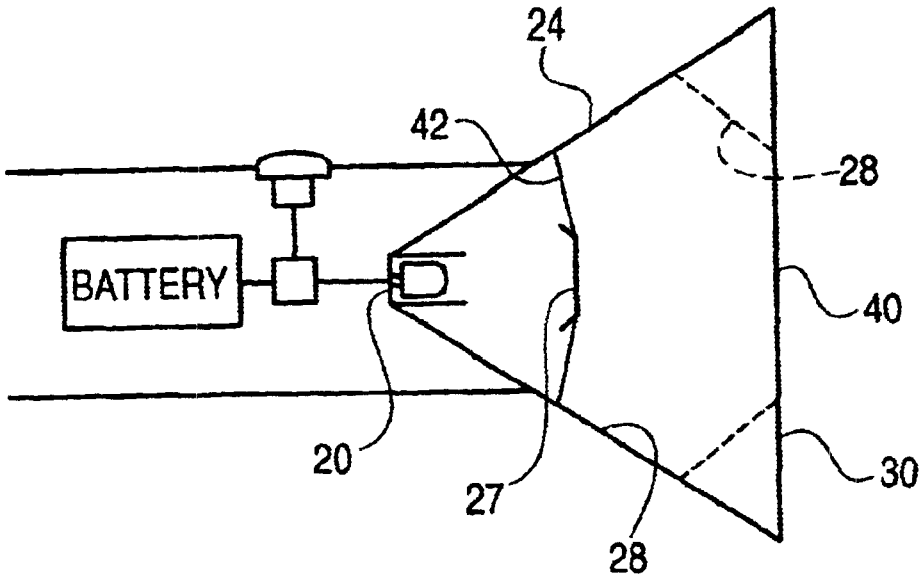
FIG. 3 is a schematic representation of the LED flashlight according another embodiment of the invention.

FIG. 3 shows another embodiment of LED flashlight 10 where the reflective surface 27 is positioned in front of light source 20 to intercept the light and reflect it back toward the reflective surfaces 28 in reflective housing 24. In this embodiment, the central support has been removed and reflective surface 27 is suspended in front of light source 20 using any suitable known support. An example of such support can be very thin or fine wires 42 that do not obstruct the internal light reflection.

Figure 5:
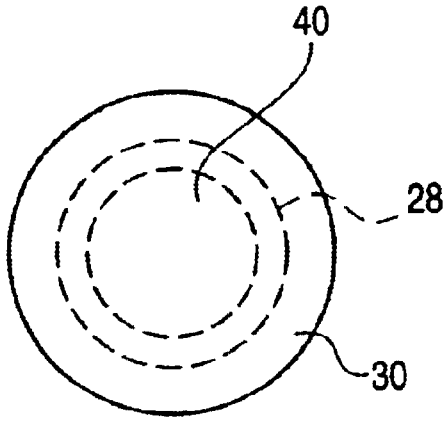
FIG. 5 is a plan view of the transparent end of the LED flashlight according to an embodiment of the invention.

In accordance with various embodiments, the transparent end 30 includes an aperture 40 that may be variable in size. FIG. 5 shows an example of the transparent end 30 showing how the variation in the internal reflective surfaces 28 can result in a change of the aperture size. The size of aperture 40 can be fixed or adjustable by the user in order to maximize the light. Those of skill in the art recognize that the position and disposition of the reflective surfaces 28 within reflective housing 24 are a matter of design choice and depend on the application (e.g., preferred distance of operation) for which the LED flashlight is intended.

Figure 4:
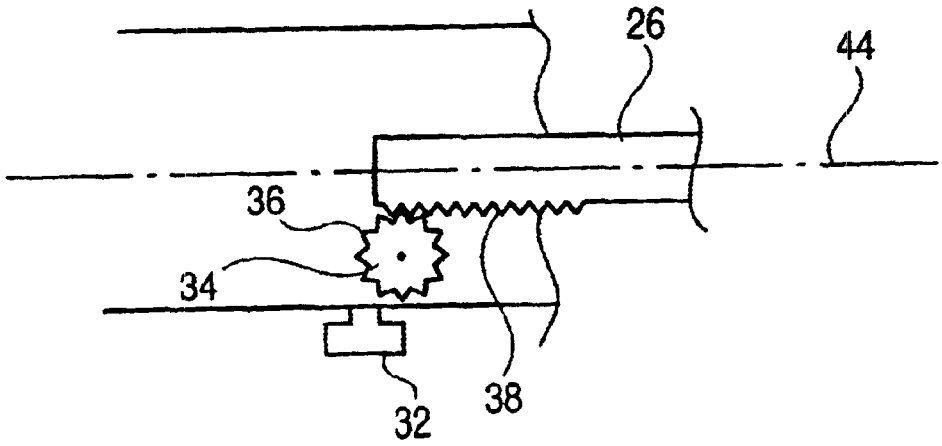
FIG. 4 is a schematic representation of an adjustment mechanism according to an embodiment of the invention.

FIG. 4 shows an adjustment system according to an embodiment of the invention. As explained with reference to the embodiments of FIGS. 1 and 2, the position of central support 26 within reflective housing 24 can be axially moved to adjust the reflection properties of the flashlight. An adjustment knob or dial 32 is connected to a gear 34 having teeth 36 that are meshed with corresponding teeth 38 on the central support 26. Thus, rotation of the knob 32 will cause central support 26 to be axially displaced along axis 44.

Figure 6:
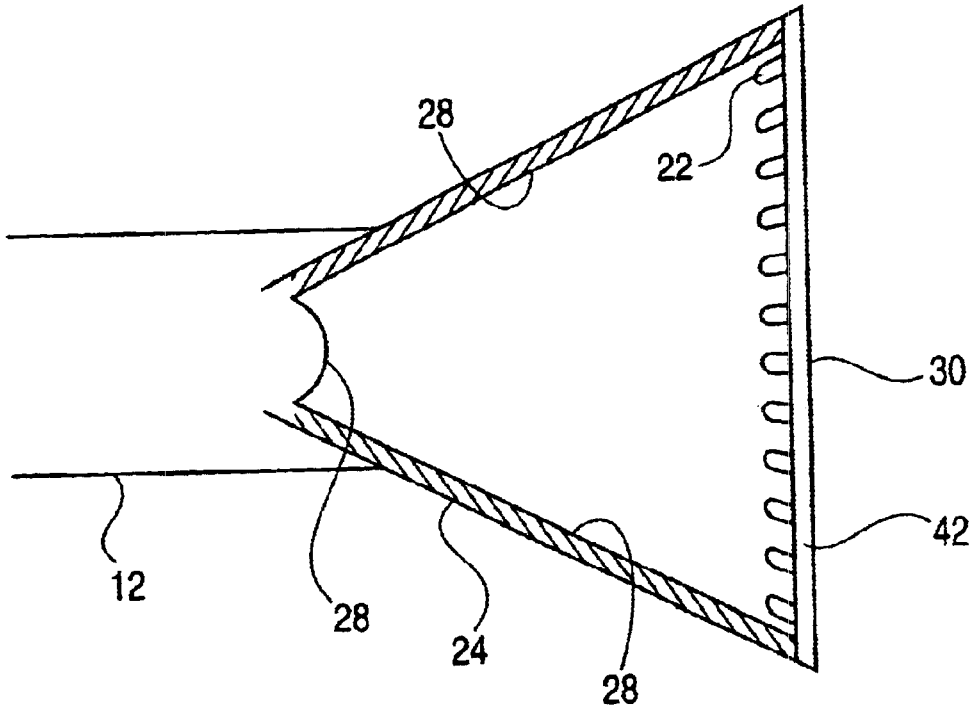
FIG. 6 is a partial cross-sectional view of the LED flashlight according to another embodiment of the invention.

FIG. 6 shows another embodiment where a plurality of LED light sources 22 are circumferentially disposed the inside of reflection housing 24 adjacent the transparent end 30, and at least one forward firing or directed LED light source 60. In this embodiment, the light emanating from LEDs 22 is directed into the reflection housing 24 such that reflective surfaces 28 operate to reflect the light out the transparent end 30. In addition to the rearward directed LEDs 22, at least one forward firing or directed LED 60 is added to supplement the light generation within the light housing 24 and provide a more vibrant light output from the flashlight. As with the previous embodiments, transparent end 30 can include an aperture 40 of variable size to change the lighting effect of the flashlight.

In accordance with other embodiments, transparent end 30 can include a lens 42 that can be a magnifying lens, a diffuser type lens or a combination of both.

Figure 7:
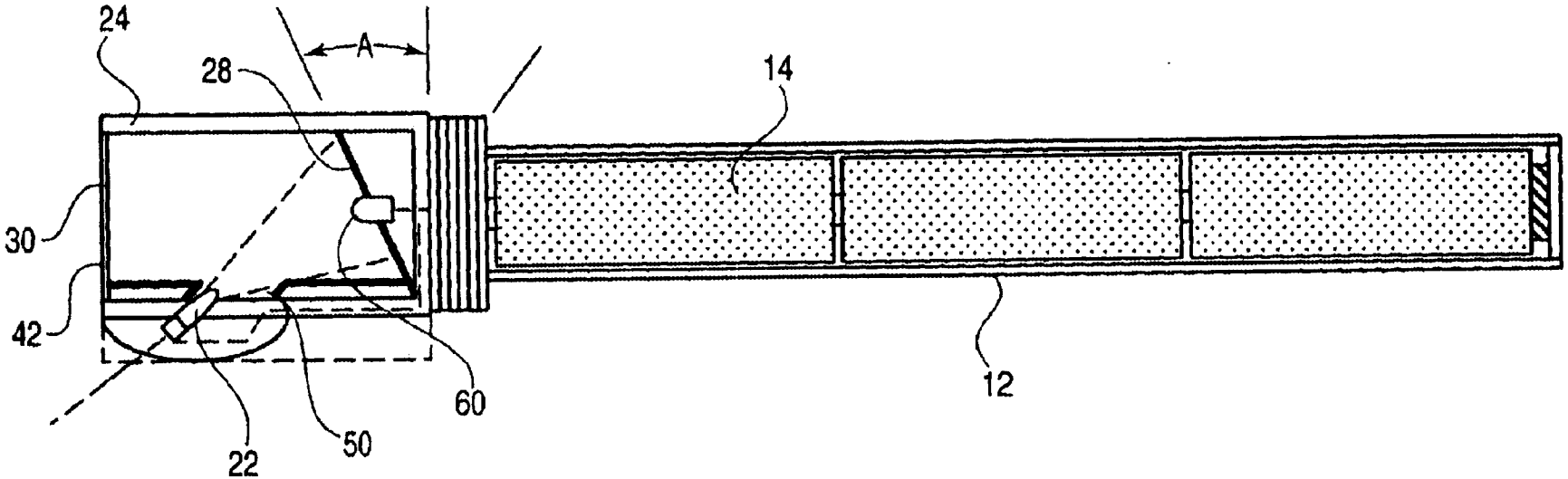
FIG. 7 is a cross-sectional view of the LED flashlight according to another embodiment of the invention.

FIG. 7 shows yet another embodiment of the invention where the light source 22 is removed from within the reflection housing 24 and disposed adjacent the perimeter of housing 24 within an appropriate aperture 50 such that the light emanating from light source 22 is substantially directed into reflection housing 24. Although only one light source 22 is shown, the addition of multiple light sources 22 disposed around the outside perimeter of reflection housing 24 with multiple respective apertures 50 is clearly within the spirit of the present invention. In addition to the rearward directed light sources 22, at least one forward directed LED 60 is added to the reflection housing 24. The forward firing LED 60 supplements the light generated within housing 24 and operates to provide a more vibrant and brighter light output from reflection housing 24.

In this embodiment, the reflective surfaces 28 within reflection housing 24 can be angled A in any desired configuration to maximize the light output from end 30. Although reflective surface 28 is shown at one angle A, those of skill in the art will recognize that various angles, including multiple angles can be used to accommodate one or more lights sources positioned outside the reflection housing 24 as shown.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A flashlight having a power source and a light emitting end, the flashlight comprising:

at least one rearward LED light source electrically connected to the power source and being positioned to direct light away from the light emitting end;

at least one forward LED light source electrically connected to the power source and being positions to direct light toward the light emitting end; and a reflection housing connected to the handle and positioned to receive the light directed away from the light emitting end and reflect it out the light emitting end.

2. The flashlight according to claim 1, further comprising a central support for supporting said at least one rearward LED light source within said reflection housing.

3. The flashlight according to claim 2, further comprising adjustment means for adjusting the position of said central support and thereby said at least one rearward LED light source within said reflection housing.

4. The flashlight according to claim 3, wherein said adjustment means comprises an adjustment knob rotatably connected to said handle, a gear mechanism connected to said adjustment knob and said central support, wherein rotation of said adjustment knob axially moves said central support.

5. The flashlight according to claim 1, wherein said reflection housing further comprises a end disposed opposite the handle, said end having a transparent end for releasing the light reflected within said housing.

6. The flashlight according to claim 1, wherein the light emitting end includes a light emitting aperture.

7. The flashlight according to claim 6, wherein the light emitting aperture is adjustable in size and shape.

8. The flashlight according to claim 1, wherein the light emitting end includes a magnifier.

9. The flashlight according to claim 1, wherein the light emitting end includes a diffuser.

10. A flashlight having a power source and a light emitting end, the flashlight comprising:

a rearward directed LED light source electrically connected to the power source;

a forward directed LED light source electrically connected to the power source; and a reflection housing connected to the handle and a central support axially disposed therein, wherein the light emitting end is part of the reflection housing and is positioned opposite said handle, and said central support includes reflective surfaces positioned in front of the rearward directed LED light source such that the light emanating from said LED light source is internally reflected within said reflection housing before released through the light emitting end.

11. The flashlight according to claim 10, further comprising adjustment means for adjusting the position of said central support and thereby said reflective surfaces within said reflection housing.

12. The flashlight according to claim 11, wherein said adjustment means comprises an adjustment knob rotatably connected to said handle, a gear mechanism connected to said adjustment knob and said central support, wherein rotation of said adjustment knob axially moves said central support.

13. The flashlight according to claim 10, wherein said forward directed LED light source comprises more than one LED.

14. The flashlight according to claim 10, wherein said rearward directed LED light source comprises more than one LED.

15. The flashlight according to claim 10, wherein the light emitting end includes a magnifier.

16. The flashlight according to claim 10, wherein the light emitting end includes a diffuser.

17. A flashlight having a power source, the flashlight comprising:

at least one rearward directed LED light source connected to the power source;

at least one forward directed LED light source connected to the power source; and a reflection housing connected to the handle and having a transparent light emitting end opposite said handle, wherein said at least one rearward directed LED light source is disposed within said reflection housing and positioned to direct light away from said light emitting end, and said at least one forward directed LED light source is positioned to emanate light in the direction of said transparent light emitting end, wherein said reflection housing receives the light directed away from said light emitting end and reflects it through said light emitting end.

18. The flashlight according to claim 17, wherein said light emitting end further comprises an aperture having adjustable size and shape.

19. The flashlight according to claim 17, wherein the light emitting end includes a magnifier.

20. The flashlight according to claim 17, wherein the light emitting end includes a diffuser.

21. A flashlight having a power source and a light emitting end, the flashlight comprising:

a reflection housing connected to the handle;

at least one rearward directed LED light source electrically connected to the power source and positioned outside said reflection housing;

at least one forward directed LED light source electrically connected to the power source; and at least one aperture in said reflection housing for receiving said at least one rearward firing LED light source such that said light source emits light into said reflection housing.

22. The flashlight according to claim 21, wherein the light emitting end includes a magnifier.

23. The flashlight according to claim 21, wherein the light emitting end includes a diffuser.

24. A flashlight having a power source, the flashlight comprising:

a plurality of rearward directed LED light sources connected to the power source;

a t least one forward directed LED light source connected to the power source; and a reflection housing connected to the handle and having a transparent light emitting end, and a plurality of light source apertures, wherein said plurality of rearward directed LED light sources are circumferentially disposed outside said reflection housing and positioned within said plurality of apertures to direct light into said reflection housing, said reflection housing having reflective surfaces positioned to capture the light emitting from said rearward directed LED light sources and reflect it through said transparent light emitting end.

25. The flashlight according to claim 24, wherein the light emitting end includes a magnifier.

26. The flashlight according to claim 24, wherein the light emitting end includes a diffuser.

* * * * *